United States Patent [19]

Turpie et al.

[11] 3,971,104

[45] July 27, 1976

[54] TEXTILE FIBER COMBING

[75] Inventors: Derek W. F. Turpie; Jaroslav Klazar, both of Port Elizabeth, South Africa

[73] Assignee: South African Inventions, Pretoria Transvaal, South Africa

[22] Filed: Aug. 13, 1974

[21] Appl. No.: 497,100

[30] Foreign Application Priority Data

Aug. 14, 1975 South Africa ..... 73/5552

[52] U.S. Cl. ..... 19/115 R; 19/125

[51] Int. Cl.[2] ..... D01G 19/10

[58] Field of Search ..... 19/115 R, 122–125, 19/215, 223–233, 8, 11–13

[56] References Cited

UNITED STATES PATENTS

| | | | |
|---|---|---|---|
| 546,600 | 9/1895 | Sharp et al. | 19/124 R |
| 3,718,944 | 3/1973 | Clark | 19/123 |

FOREIGN PATENTS OR APPLICATIONS

| | | | |
|---|---|---|---|
| 2,620 | 1896 | United Kingdom | 19/223 |
| 12,534 | 1910 | United Kingdom | 19/231 |

*Primary Examiner*—Dorsey Newton

*Attorney, Agent, or Firm*—Irvin A. Lavine

[57] ABSTRACT

A method of combing textile and the like fibers is provided in which the free end or fringe of a sliver of fibers is clamped, a section of the sliver adjacent the clamped fringe is combed leaving the fringe itself uncombed. Thereafter the clamp is released and the fringe of the sliver is combed. After fringe-combing, the fibers which have been combed by these two operations are drawn off from the sliver through a comb element to comb the tail ends thereof. Apparatus adapted to carry out the method of combing is provided and includes combing means comprising a clamp for clamping the free end or fringe of a sliver of fibers and a comb element relatively movable with respect to the clamp to effect combing of the sliver adjacent the clamp, means to comb the fringe of the sliver when released from the clamp and means to draw off the thus partly combed fibers through a comb element to comb the tail ends thereof.

19 Claims, 8 Drawing Figures

TEXTILE FIBER COMBING

This invention relates to or is for improvements in textile fibre combing.

Textile fibres are combed to remove short fibres, neps, vegetable and other impurities. The two most commonly used machines for combing fibres are the rectilinear combing machine and the Noble combing machine. Recently certain combinations of these machines have been proposed to incorporate the advantages of both machines into a single machine. However, certain disadvantages of both machines have remained or have not been solved by these proposals. For example, in all Noble comb type arrangements there is an inherent limitation on the number of operations that can be performed in a single revolution due to the fact that the diameter of the mechanism cannot be indefinitely enlarged.

To ensure that all the fibres in the fringe are combed the fringe combing means in some combs have to be specially constructed and also accurately set so that the pins on the fringe combing means comb the fibres close to the fibre clamps. However, if the fringe combing means are set too close to the fibre clamps there is a danger of fibre breakage, and if the fringe combing means are set too far away a portion of the fringe may escape this initial combing. It has therefore been necessary in some cases to include a negative feed or a top comb at one stage in the cycle to ensure that the whole length of the fibre is combed.

To overcome the above disadvantage it is proposed to "middle-comb" the slivers of fibres before "end" or "fringe-combing" the slivers. By "middle-combing" is meant combing a section of the fibres adjacent the free end of the sliver but leaving the fringe itself uncombed. It will then be possible to feed the sliver into a position where the rotary comb or combs of the fringe comb means may be set so that in combing the fringe the pins on the comb or combs enter the fibres in the already middle-combed area. The setting of the rotary comb need thus not be as accurate or as close to the fibre clamps as in previous methods and the danger of breaking fibres is thus reduced. Furthermore it is envisaged that the linear nature of the apparatus will simplify the design of the apparatus and of its parts and accessories.

It is accordingly an object of the present invention to provide a method and apparatus for combing textile and like fibres which, while incorporating features of the methods used in combining the rectilinear machine with the Noble machine, include advantages which the applicant believes will be useful.

According to the invention a method of combing textile and like fibres includes the steps of feeding the slivers into a position suitable for combing, clamping the free end or fringe of the sliver, middle-combing the thus clamped sliver at a point adjacent the clamped end thereof, releasing the clamp, fringe-combing the sliver end, drawing off the thus partly combed fibres from the sliver, combing a section of the fibres adjacent and following the middle-combed zone of the fibres and advancing the sliver for repetition of the cycle.

Further according to the invention the method includes the steps of feeding the sliver into a position suitable for combing, causing it to be engaged with a comb element, clamping the free end or fringe of the sliver, middle-combing the sliver by relative movement of the comb element and the sliver, subsequently feeding the sliver into a fringe-combing zone, securing it while rotary combing means comb the leading end of the sliver, releasing the sliver, drawing off the thus partly combed fibres from the sliver through the comb element to comb the fibre tails, and advancing the trailing uncombed region of the sliver for repetition of the cycle.

The sliver is preferably secured against movement in a longitudinal direction of the fibres during fringe-combing and middle-combing operations and released during other operations of the cycle.

The sliver is preferably caused to engage with the comb element in such a way that a fringe of the sliver protrudes beyond the comb element. In this way the fringe may be clamped in any suitable manner and a pull imparted to it to draw the sliver through the comb element to effect middle-combing of the sliver. In one embodiment the pull is effected by twisting and lifting the clamped end of the sliver relative to the remainder thereof. The twist and lift is preferably effected by trapping the free end of a sliver in a jaw device movable about an axis substantially perpendicular to the line of advance of the sliver and freeing the sliver from the jaw once the pull has been imparted to the sliver. The jaw device may be defined at a nip zone between an endless belt and a roller and the free end of the sliver is urged into the nip to effect the desired clamp, the pull being exerted by maintaining the belt in contact with the roller to a release point where the belt diverges from the roller.

In a preferred embodiment of the invention the sliver remains in engagement with the comb element throughout the cycle of operations after it has been caused to engage with the comb element in the middle combing zone and until immediately after the drawing off process when the sliver is lifted clear of the comb element in preparation for a repetition of the cycle. In this way the comb element assists the feed of the sliver in a longitudinal direction of the fibres and also enables the feed in this direction to by accurately controlled. In addition, the fact that the sliver is still in engagement with the comb element during the drawing off process means that the tails of the fibres drawn off pass through the comb element and are thus subjected to a combing action during the drawing off process.

Further according to the invention, apparatus for carrying out the method of the invention, includes middle-combing means comprising a clamp for clamping the end or fringe of a sliver of fibres and a comb element relatively movable with respect to the clamp to effect combing of the sliver adjacent the clamp, fringe-combing means trailing the clamp to comb the fringe of the sliver when released from the clamp, means for removing the thus partly combed fibres from the sliver and means to advance the sliver through all stages of the apparatus.

Also according to the invention the apparatus includes means to effect combing of the fibres adjacent and following the already middle-combed section of the sliver. Preferably this means comprises the comb element, the combing of the section referred to in the previous sentence taking place simultaneously with the removal of the middle- and fringe-combed fibres.

Also according to the invention the advancing means preferably includes a track, an endless chain or the like movable on the track, the chain adapted to act as an anchorage for the comb element. The comb element is movable with the chain and is adapted to be movable relative to the chain in addition. In this way the comb element may act as a sliver feeding means both in the longitudinal direction of the fibres and in a lateral direction.

The clamp means, fringe-combing means and means for removing combed fibres from the sliver are all preferably located adjacent the track and arranged so that the comb element moves past them. Means for storing sliver, laps or the like of fibres, such as creels, are preferably included in the apparatus and arranged to move a track with the comb element, past the stationary elements described above. Such a creel and associated comb element may comprise a single mobile unit and in a preferred embodiment of the invention the apparatus includes a plurality of such units moving on the track.

The apparatus may also include a plurality of stationary units including clamping means, at least part of the middle-combing means, fringe-combing means, drawing off means and means to convey the combed fibres to a suitable disposal point.

The track may include one linear section but preferably comprises two linear substantially parallel sections with two curved sections at the end thereof to provide paths from the one linear section to the other. In this way additional units may be incorporated in the apparatus without much inconvenience. The plane which the track defines is preferably substantially horizontal but in other embodiments of the invention the plane may be at any suitable angle. All the units will be readily accessible due to the shape of the track.

The number of combing and drawing off operations that can be done in, say, a single revolution of a unit around the track can also be easily and suitably chosen.

The comb element (or feed comb as it may alternatively be termed) preferably comprises a bottom pin segment and a top pin segment, the segments being movable between a closed position, in which the pins of the one segment are located in gaps between the pins of the other segment and vice versa, to an open position in which the pins of the segments are entirely separated. The density of the pin field created by the comb element in the closed position is similar to that of the Noble comb large circle but the rows are preferably linear and not curved in any way. It will be appreciated that the density of the pin field of each pin segment will be approximately half that of the Noble comb large circle. Furthermore, the comb element preferably includes nipper formations which are adapted to clamp the sliver when the segments are in the fully closed position. Preferably the nipper formations are set back from the front pins of the comb element.

In one embodiment of the invention the comb elements may be constructed in sections adapted removably to fit together. It will be possible in this way to vary the tooth or pin density on the comb element and to replace worn or broken sections thereof without having to replace the whole comb element.

The middle-combing clamp means preferably includes an endless belt draped over a clamp pulley with its rotational axis substantially perpendicular to the line of advance of the comb element, the belt and the pulley defining a jaw arrangement for nipping the free end or fringe and holding the end until a release point is reached where the belt diverges from the pulley.

Preferably the belt and pulley system is located adjacent the track with one section of the belt lying parallel to the track. A fringe of the sliver protruding from the comb element may thus be folded over an edge of the belt and a finger is provided to steer the fringe of the sliver into the jaw arrangement. The belt is adapted to be driven at approximately the same speed and in the same direction as the movement of the comb element. In this way the fringe that has been steered over the edge of the belt by the finger may be trapped between the belt and the pulley and thus be drawn a short distance out of the comb element. The distance which the sliver is drawn out is dependent on the angle of contact of the belt with the pulley which may be varied by adjusting the relationship of the pulleys on which the belt runs.

The fringe combing means is preferably in the form of a rotary comb. It is possible to have a plurality of such combs, each having, for example, a different pin density and/or different positioning in relation to the track or each other.

Further features of the invention will be illustrated in the description hereunder which is given as an example.

The description is with reference to the drawings in which.

Figures 1, 2:
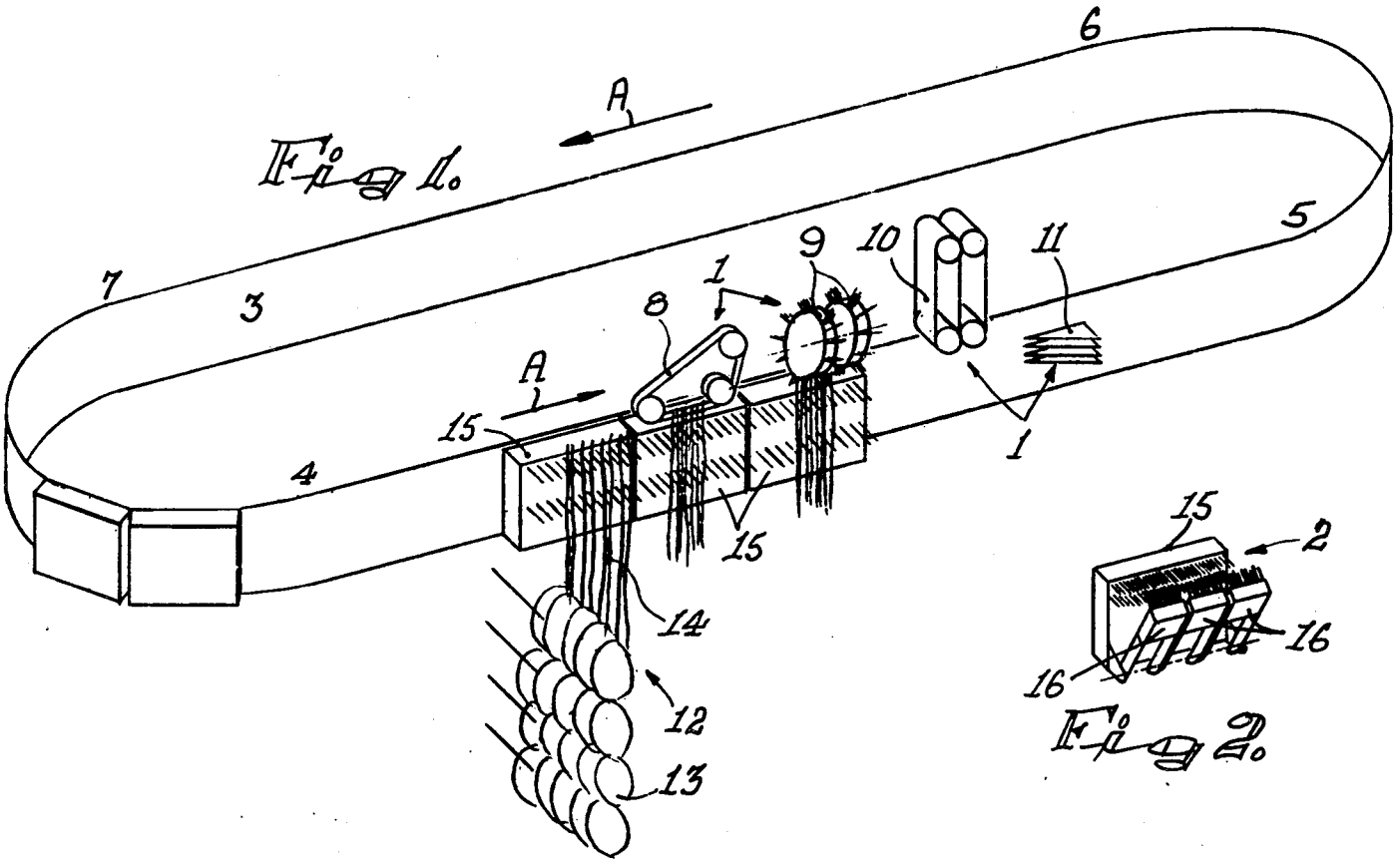
FIG. 1 is a diagrammatic representation of textile fibre combing apparatus according to the invention.
FIG. 2 is a diagrammatic representation of a comb element or feed comb.

Referring to the drawings the textile fibre combing apparatus comprises a series of combing heads 1 (of which only one is shown in FIG. 1), a plurality of comb elements 2 mounted on an endless track 3 for movement past the combing heads. The comb element is adapted to be driven continuously on the track in direction A. The track is linear from points 4 to 5 and from 6 to 7. Guide means for the comb elements 2 to enable them to move in directions transverse to the movement of the track are also provided but are not indicated in FIG. 1. The guide means may be cams. Clark, U.S. Pat. No. 3,718,944 shows cams for operating combs.

The combing heads 1 which are preferably stationary and past which the comb element is adapted to move along the track, comprise a clamping mechanism 8, rotary comb means 9, fibre withdrawal rollers 10 and lifting knives 11. Means to convey the drawn off fibres to a distribution point are also included but are not shown in FIG. 1.

What may be termed as a mobile unit is indicated generally at 12 and comprises creels 13 which are adapted to hold slivers or laps of fibres for feeding into associated comb elements 2. The creels are movable and follow the comb elements at substantially the same linear speed. The slivers 14 are fed in a vertical direction onto comb elements 2 from creels 13 and follow a trajectory parallel to that of the track. The apparatus may comprise any suitable number of combing heads 1 which can be located within the space of the linear section of the track 4 to 5 or 6 to 7, and may also comprise any suitable number of feed combs 2 and any suitable number of mobile units 12. In this way a multiple-head combing machine may be formed.

Figure 3:
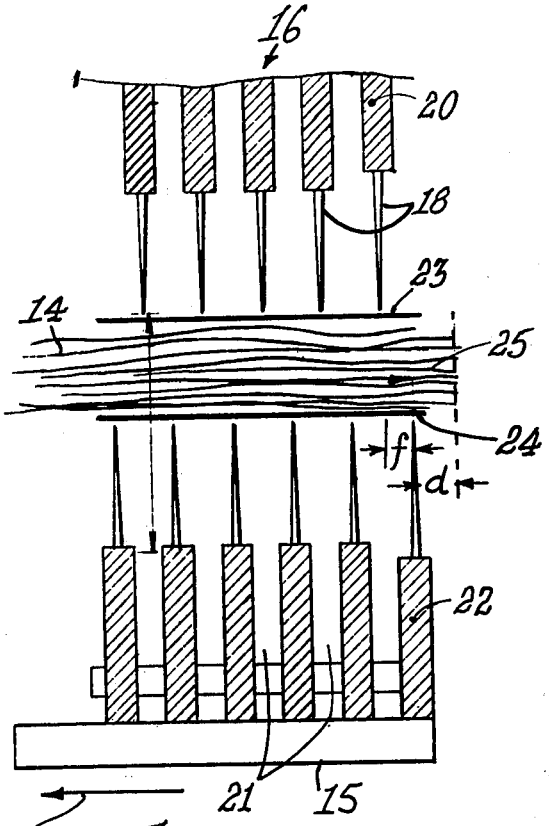
FIG. 3 is a cross-sectional view of a comb element at one stage in the combing operation.
Figure 4:
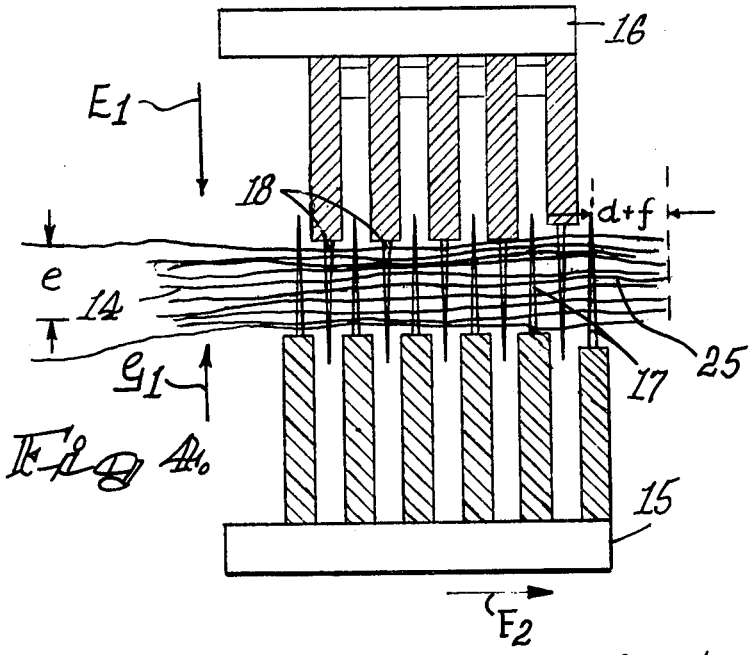
FIG. 4 is a cross-sectional view of a comb element at another stage in the combing operation.
Figure 5:
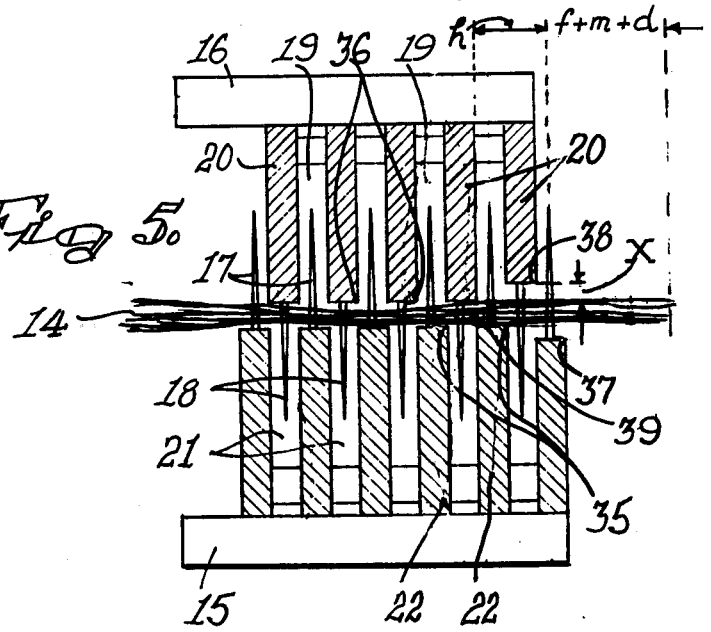
FIG. 5 is a cross-sectional view of a comb element in a further stage of the combing operation.

Referring to FIGS. 2 to 5 the comb elements 2 are shown in greater detail and various stages in the combing operation are illustrated. The comb element 2 comprises a bottom pin segment 15 and a top pin segment 16, the segments 15 and 16 are movable from an open position in which the pins 17 of segment 15 and the pins 18 of segment 16 are entirely separated as shown in FIG. 3, to an intermediate position in which the pins intersect each other as shown in FIG. 4 and to a closed position in which the pins 17 of segment 15 are located in the open spaces 19 between the bodies of individual combs 20 and the pins 18 of segment 16 are located in the open spaces 21 between the bodies of individual combs 22 as shown in FIG. 5.

Referring to FIGS. 3 and 4 of the drawings the function of the comb element 2 during one stage of the combing operation is described. FIG. 2 shows the end of a previous cycle where sliver 14 has been removed from the pins 17 and 18 by lifting knives 11 (see FIG. 1) and has been guided in between two stationary platforms 23 and 24 (see FIG. 3). As the slivers 14 pass between the stationary platforms the comb element 2 moves in direction A (shown in FIG. 1) but during the same time moves a distance $f$ in direction $F_1$ which is toward the creels 13. The slivers are caused to follow the comb element in the direction A. After the comb element 2 has moved a distance $f$ the slivers 14 exit from in between the platforms 23 and 24 and the pins of the comb element are caused to penetrate the slivers 14. The top pin segment 16 may be moved a distance $e$ in penetrating direction $E_1$ (or alternatively both segments 15 and 16 may be moved in penetrating directions $G_1$ and $E_1$ respectively so that the total distance moved is $e$). The pin segments are therefore in the intermediate position shown in FIG. 4. Thereafter the comb element 2 is moved a distance $f$ in the direction $F_2$ (which is away from creels 13 and opposite to direction $F_1$) and the resulting position of the pin segments and the slivers is shown in FIG. 4. The size of the sliver fringe 25 has therefore increased by $f$ to $f+d$, $d$ being the size of the fringe shown in FIG. 3.

At this stage of the operation it is possible to grasp the fringe 25 of the sliver 14 and draw the sliver 14 through the pins 17 and 18 and in this way perform middle-combing.

Figure 6:
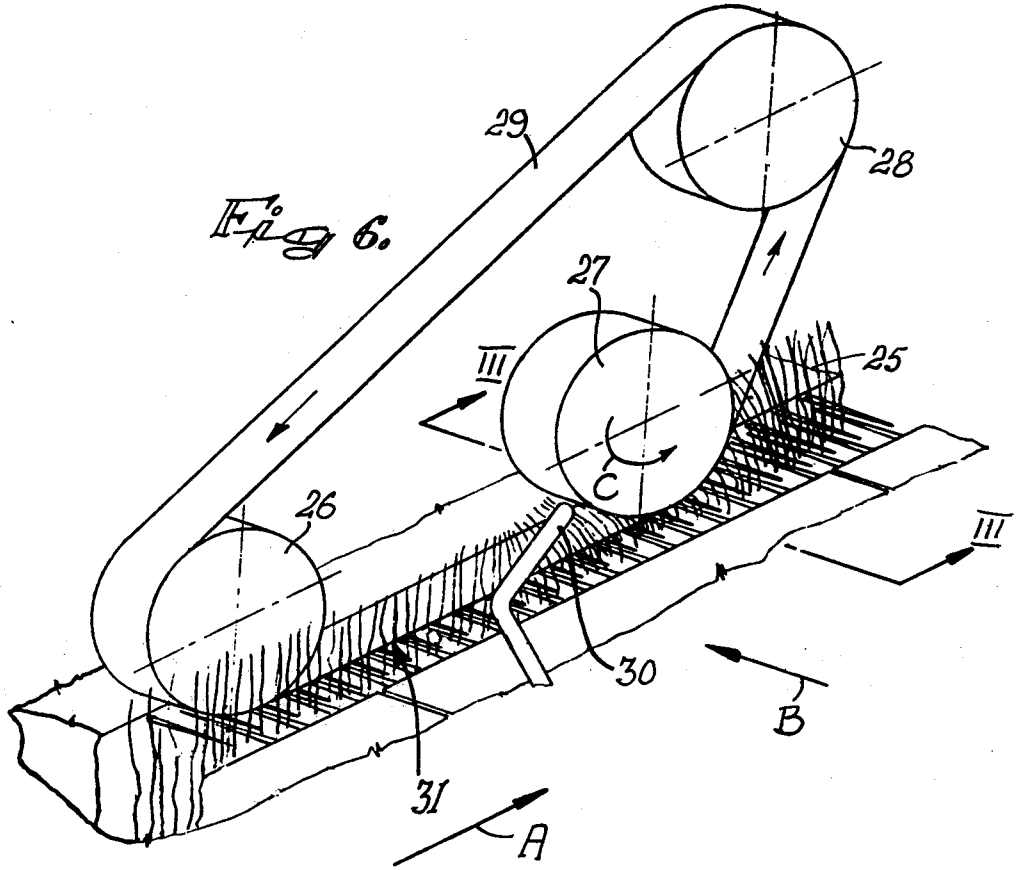
FIG. 6 is a diagrammatic representation of the clamping means.

Referring to FIG. 6 a schematic perspective view of a clamping arrangement, which is also adapted to draw the sliver through the pins of the comb element 2, is shown. The clamping mechanism comprises three pulleys 26, 27 and 28 and endless belt 29 around the pulleys and a finger or fringe guide 30. The pulley 27 is positively driven so that belt 29 moves at approximately the same speed and in the same direction as the comb elements 2.

Furthermore, the section of belt 29 between pulleys 26 and 27 is located as close as possible to the first row of pins of the comb element. This section of the belt is also located so that fringe 25 rests against the edge of the belt. As fringe 25 is moved in direction A, fringe guide 30, which is located in front of pulley 27, bends the fringe 25 around the belt edge 31 to guide it into the nip between the belt 29 and the pulley 27.

Figure 7:
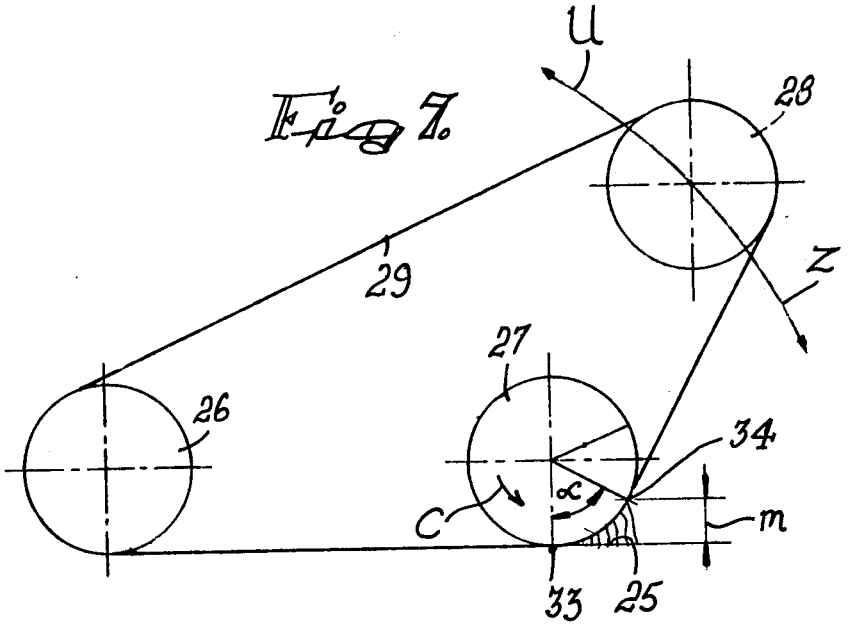
FIG. 7 is a view in direction B of FIG. 6.
Figure 8:
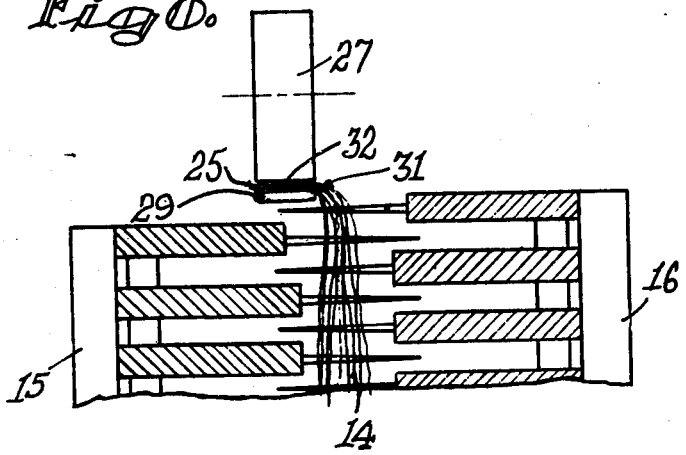
FIG. 8 is a view along line III—III of FIG. 6.

Referring to FIG. 8, which is a section along line III—III of FIG. 6, the fringe is shown gripped between the belt and pulley at position 32. The middle-combing action is further illustrated with reference to FIG. 7 which is a view in direction B of FIG. 6. The diagrammatic view in FIG. 7 shows the initial point of grip of the sliver between the belt and the pulley at point 33. Due to the rotation of the pulley 27 (indicated by arrow C) and the angle of contact $\alpha$ between the belt and the pulley, the belt grips the fringe 25 and pulls the fibres through the pins 17 and 18 (not shown in FIG. 7) by a distance $m$ thus performing the middle combing. When the fibres of fringe 25 reach the point 34, the belt grip on the fibres is released and the middle-combing action is complete. The degree of middle-combing is shown as $m$ which is the distance that the fringe 25 has been drawn out of the comb element 2. The amount $m$ is adjustable by altering the angle of contact $\alpha$ which is achieved by re-positioning the pulley 28. Moving pulley 28 in a direction U will increase the angle of contact and the amount $m$, and moving it in direction Z will reduce the angle of contact and consequently also the amount $m$.

Referring to FIG. 5 the function of the comb element 2 in operations subsequent to middle combing will now be described. At this stage the sliver 14 is clamped by means of flat sections 35 and 36 of combs 22 and 20 respectively, the pin segments having been moved to the fully closed position as shown in FIG. 5. The flat sections 37 and 38 of the front two combs are set back by a distance $x$ to ensure that no nip on the fibres of sliver 14 exists between zone 39 of the sliver and the end of the fringe of the sliver. The fringe is in this way brought into a condition ready for combing by the rotary fringe combs 9 (see FIG. 1) and it will be appreciated that only fibres within the zone $h+f+m+d$ will be removed by the rotary fringe combs 9 into the noil. It will be further appreciated that all the values $h, f, m$ and $d$ may be adjusted to suit the material being processed. After fringe-combing by rotary combs 9 has been completed the comb element segments 15 and 16 are opened, preferably to the same position as for middle-combing which is shown in FIG. 4. Thereafter conventional withdrawal rollers 10 (see FIG. 1) are used to withdraw the fibres through the pins 17 and 18 thus combing the fibre tails and the combing cycle is then completed. The comb element segments are then fully opened (see FIG. 2) and the lifting knives 11 (and a second set of lifting knives not shown in the drawings) lift the fibres out of the pins and into the position shown in FIG. 3 from where the cycle may be repeated.

The preferred embodiment described above has been with respect to an arrangement in which the sliver has been pulled through the comb element to effect middle-combing. However, it will be appreciated that middle-combing may also be effected by maintaining the clamped fringe of the sliver stationary and moving the comb element through the sliver. Thus it will be appreciated that many variations in detail may exist without departing from the spirit of the invention. In the same way certain other variations may be added which have not been shown in the drawings. Thus, for example, the rotary combs 9 may have different pin settings or may have different pin densities; the number of combing heads may be varied to any suitable number and means for removing noil from the rotary comb pins may also be included. These and the like variations in detail are all envisaged as falling within the scope of the invention.

We claim:

1. A method of combing textile and the like fibres including the steps of feeding a sliver of fibres into a position suitable for combing, said sliver having a free end or fringe, clamping the free end or fringe of the sliver, combing the portion of the thus clamped sliver which follows the clamped end thereof, releasing the free end or fringe, combing the sliver free end or fringe, the sliver thereby having uncombed a portion which adjacently follows the combed portion, combing said uncombed portion of the fibres adjacent and following the combed portion of the fibres, drawing off fibres from the thus combed sliver, and advancing the sliver for repetition of the cycle.

2. A method as claimed in claim 1, and further comprising pulling the clamped free end of the sliver to draw the sliver through a comb element to effect combing of the portion of the sliver which follows the clamped end thereof.

3. A method as claimed in claim 2, wherein the step of combing the section of the fibres adjacent and following the combed portion of the fibres is effected by said step of drawing off the fibres from the sliver through the comb element.

4. A method of combing textile and the like fibres including the steps of feeding a sliver of fibres into a position suitable for combing, said sliver having a free end or fringe, clamping the free end or fringe of the sliver, relatively moving the clamped free end of the sliver and a comb element which penetrates the sliver to effect combing of the portion of the sliver which follows the clamped end thereof, releasing the clamped free end or fringe, combing the sliver free end or fringe, the sliver thereby having uncombed a portion which adjacently follows the combed portion, combing said uncombed portion of the fibres adjacent and following the combed portion of the fibres, drawing off fibres from the thus combed sliver, and advancing the sliver for repetition of the cycle.

5. A method as claimed in claim 4, wherein the step of combing the section of the fibres adjacent and following the combed portion of the fibres is effected by said step of drawing off the fibres from the sliver through the comb element.

6. A method of combing textile and the like fibres including the steps of feeding a sliver of fibres into a position suitable for combing, said sliver having a free end or fringe, clamping the free end or fringe of the sliver, penetrating the portion of the sliver following the clamped end thereof with a comb element, moving the clamped end of the sliver relative to the remainder thereof to impart a pull to the clamped end of the sliver to draw it through the comb element to effect combing of the portion of the sliver which follows the clamped end, releasing the free end or fringe, combing the sliver free end or fringe, the sliver thereby having uncombed a portion which adjacently follows the combed portion, combing said uncombed portion of the fibres adjacent and following the combed portion of the fibres, drawing off fibres from the thus combed sliver, and advancing the sliver for repetition of the cycle.

7. The method claimed in claim 6 in which the moving of the clamped end is effected by imparting twist and lift motion thereto.

8. The method claimed in claim 7, in which the twist and lift motion is effected by said clamping of the free end of the sliver and then moving the sliver clamped end about an axis substantially perpendicular to the line of advance of the sliver, and freeing the sliver from being clamped once the pull has been imparted to the sliver.

9. Apparatus adapted to comb textile and the like fibres including combing means comprising a clamp for combing a free end or fringe of a sliver of fibres and at least one comb element relatively movable with respect to the clamp, the clamp including an endless belt draped over a clamp pulley with its rotational axis substantially perpendicular to the line of advance of the comb element, the belt and the pulley defining a clamp arrangement for nipping the free end of the fringe and holding the end until a release point is reached where the belt diverges from the pulley thus effecting combing of the portion of the sliver which adjacently follows the clamp, fringe combing means trailing the clamp to comb the fringe of the sliver after said fringe has been released from the clamp, means for combing a portion of the sliver which adjacently follows the already combed portion of the sliver, comprising drawing off means for drawing off fibres from the sliver and for drawing a section of the fibres adjacent and following the already combed portion of the fibres through a said comb element, and means to advance the sliver through the apparatus.

10. Apparatus as claimed in claim 9 in which guide means is provided to steer the fringe of the sliver into the clamp arrangement.

11. The apparatus as claimed in claim 10 in which the comb element comprises a top pin segment and a bottom pin segment, the segments being movable between an open position in which the pins of the one segment are entirely separated from the pins of the other segment and a closed position in which the pins of the one segment intersect the pins of the other segment.

12. Apparatus adapted to comb textile and the like fibres including combing means comprising a clamp for clamping the free end or fringe of a sliver of fibres, and a comb element relatively movable with respect to the clamp to effect combing of the sliver adacent the clamp, the comb element comprising a top pin segment and a bottom pin segment, the segments being movable between an open position in which the pins of one segment are entirely separated from the pins of the other segment and a closed position in which the pins of the one segment intersect the pins of the other segment, means trailing the clamp for combing the fringe of the sliver when released from the clamp, combing means comprising drawing off means for removing fibres from the sliver, and for drawing a section of the fibres adjacent and following the already combed section of the fibres through a comb element, and means to advance the sliver through the apparatus.

13. Apparatus adapted to comb textile and the like fibres including combing means comprising a clamp for clamping the free end or fringe of a sliver of fibres, at least one comb element positioned to penetrate a portion of a sliver following the free end or fringe thereof and means for relatively moving a said comb element and clamp, fringe combing means for combing the fringe of the sliver after the portion of the sliver which adjacently follows the free end or fringe has been combed, means for combing a portion of the sliver which adjacently follows the already combed portion of the sliver comprising drawing off means for removing fibres from the sliver and for drawing a section of the fibres adjacent and following the already combed portion of fibres through said comb element and means to advance the sliver through the apparatus.

14. Apparatus as claimed in claim 13, wherein the comb element of said tail combing means is said first mentioned comb element.

15. Apparatus adapted to comb textile and the like fibres including combing means comprising a clamp for clamping a free end or fringe of a sliver of fibres, at least one comb element positioned to penetrate a portion of a sliver following the free end or fringe thereof, and means for relatively moving said comb element and clamp, fringe combing means for combing the fringe of the sliver after the portion of the sliver which adjacently follows the free end or fringe has been combed, means for combing a portion of the sliver which adjacently follows the already combed portion of the sliver, comprising drawing off means for drawing off fibres from the sliver and for drawing a section of the fibres adjacent and following the already combed portion of the fibres through said comb element, and means to advance the sliver through the apparatus including a track, an endless chain movable on the track, the chain having a said comb element secured thereto.

16. Apparatus as claimed in claim 15 wherein the track includes two linear substantially parallel sections with two curved sections at the ends thereof, to provide paths from the one linear section to the other.

17. The apparatus claimed in claim 15 in which the clamp includes an endless belt draped over a clamp pulley with its rotational axis substantially perpendicular to the line of advance of the comb element, the belt and the pulley defining a clamp arrangement for nipping the free end of the fringe and holding the end until a release point is reached where the belt diverges from the pulley.

18. The apparatus claimed in claim 17 in which guide means is provided to steer the fringe of the sliver into the clamp arrangement.

19. The apparatus claimed in claim 15 in which the comb element comprises a top pin segment and a bottom pin segment, the segments being movable between an open position in which the pins of the one segment are entirely separated from the pins of the other segment and a closed position in which the pins of the one segment intersect the pins of the other segment.

* * * * *